US005219073A

United States Patent [19]

Cowie

[11] Patent Number: 5,219,073

[45] Date of Patent: Jun. 15, 1993

[54] PREPACKAGED KIT OF TOOLS

[75] Inventor: Jeffrey P. Cowie, Whitefish Bay, Wis.

[73] Assignee: Johnson Level & Tool Mfg. Co., Inc., Mequon, Wis.

[21] Appl. No.: 861,072

[22] Filed: Mar. 31, 1992

[51] Int. Cl.[5] ..... B65D 69/00

[52] U.S. Cl. ..... 206/234; 206/223; 206/373; 206/461

[58] Field of Search ..... 206/223, 234, 224, 349, 206/371, 372, 373, 471, 461; 33/390, 371, 382

[56] References Cited

U.S. PATENT DOCUMENTS

| | | | |
|---|---|---|---|
| 3,620,362 | 11/1971 | Valdes | 206/224 |
| 3,826,013 | 7/1974 | Baher | 33/390 |
| 4,056,190 | 11/1977 | Dix | 206/373 |
| 4,199,060 | 4/1980 | Howard | 206/471 |
| 4,887,717 | 12/1989 | Secrest, Jr. | 206/223 |
| 4,982,840 | 1/1991 | Bidwell et al. | 206/223 |

OTHER PUBLICATIONS

Johnson Level & Tool Manufacturing Co., Inc. Catalog 87-1 Leadership in: Products Packaging Merchandising, 1987.

*Primary Examiner*—David T. Fidei

*Attorney, Agent, or Firm*—Andrus, Sceales, Starke & Sawall

[57] ABSTRACT

An assembled and prepackaged kit of tools for use in constructing a deck or the like includes a post level, a conventional frame-type level, a square, a chalk line reel and chalk, a line level and a carpenter's pencil. These tools are placed against the front surface of a card or panel, and are shrink wrapped onto the panel to assemble the tools into a package. The tools are adapted to be used in constructing a deck or other such structure.

6 Claims, 2 Drawing Sheets

PREPACKAGED KIT OF TOOLS

BACKGROUND AND SUMMARY

This invention pertains to tools, and more particularly to a prepackaged kit of tools and a method of assembling and packaging a kit of tools.

In recent years, decks have become an increasingly popular home improvement. A simple deck is relatively easy to build, and accordingly deck construction is often carried out by the homeowner. Recognizing this trend, many retail building supply establishments offer pre-cut deck kits which can be purchased by the homeowner.

Certain tools are necessary in constructing a deck. It is often the case that the homeowner may have some, but not all, of such tools.

It is an object of the present invention to provide a prepackaged kit of tools, containing substantially all tools necessary to carry out construction of a deck or the like. It is a further object of the invention to provide a prepackaged kit of tools in which the tools can be viewed by the potential purchaser prior to purchase. It is a further object of the invention to provide a kit of tools which contains a sufficient quantity and character of tools to assist a homeowner in constructing even a relatively complex deck or like structure.

In accordance with the invention, a prepackaged kit of tools includes a post level, a frame-type level, one or more marking instruments, and a square. The tools are contained together in a package. The package preferably provides visual access to the tools when the tools are contained within the package. In a preferred form, the package is made up of a panel having a front surface against which the tools are placed, and a web of transparent material bonded to the front surface of the panel to retain the tools in predetermined positions thereon. The web of transparent material is preferably shrink-wrapped onto the front surface of the panel, and includes an adhesive on its rear surface for contacting the front surface of the panel in locations between the tools to adhere to the panel.

In addition to the post level and the frame-type level, the kit further includes a line level. The one or more marking instruments contained in the prepackaged kit consist of a chalk line reel and a pencil. A container of chalk is preferably included in the kit for filling the chalk line reel.

The invention further contemplates a method of assembling and packaging a kit of tools. The method consists of providing a panel having a front surface, and placing the following tools against the front surface of the panel: a post level; a frame-type level; one or more marking instruments; and a square. A transparent wrap material is placed over the tools, and wrap material is bonded to the front surface of the panel in locations between the tools to maintain the tools in position on the panel front surface. The tools which are assembled and packaged into the kit are substantially as summarized previously.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
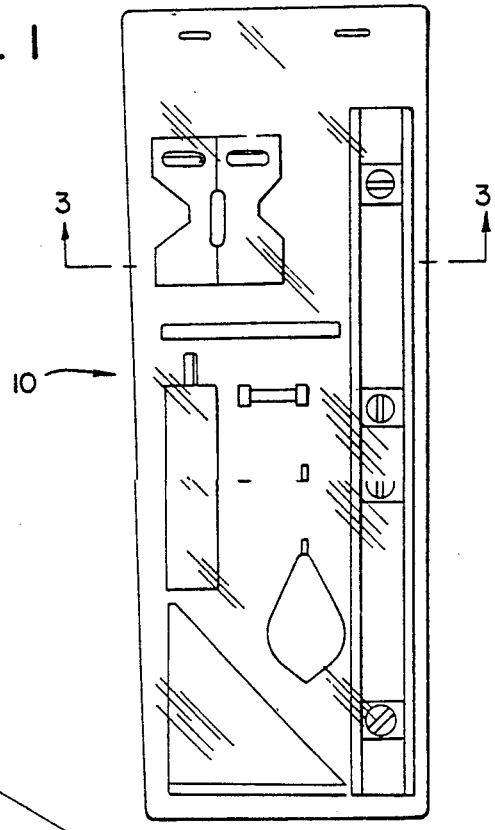
FIG. 1 is a front elevation view of a kit of tools assembled and packaged according to the invention.

Referring to FIG. 1, a prepackaged kit of tools 10 is illustrated. Broadly, kit 10 consists of a number of tools suitable for use in constructing a deck or other general construction projects, which are packaged onto a panel and retained in place by means of a transparent shrink-wrap material.

Figure 2:
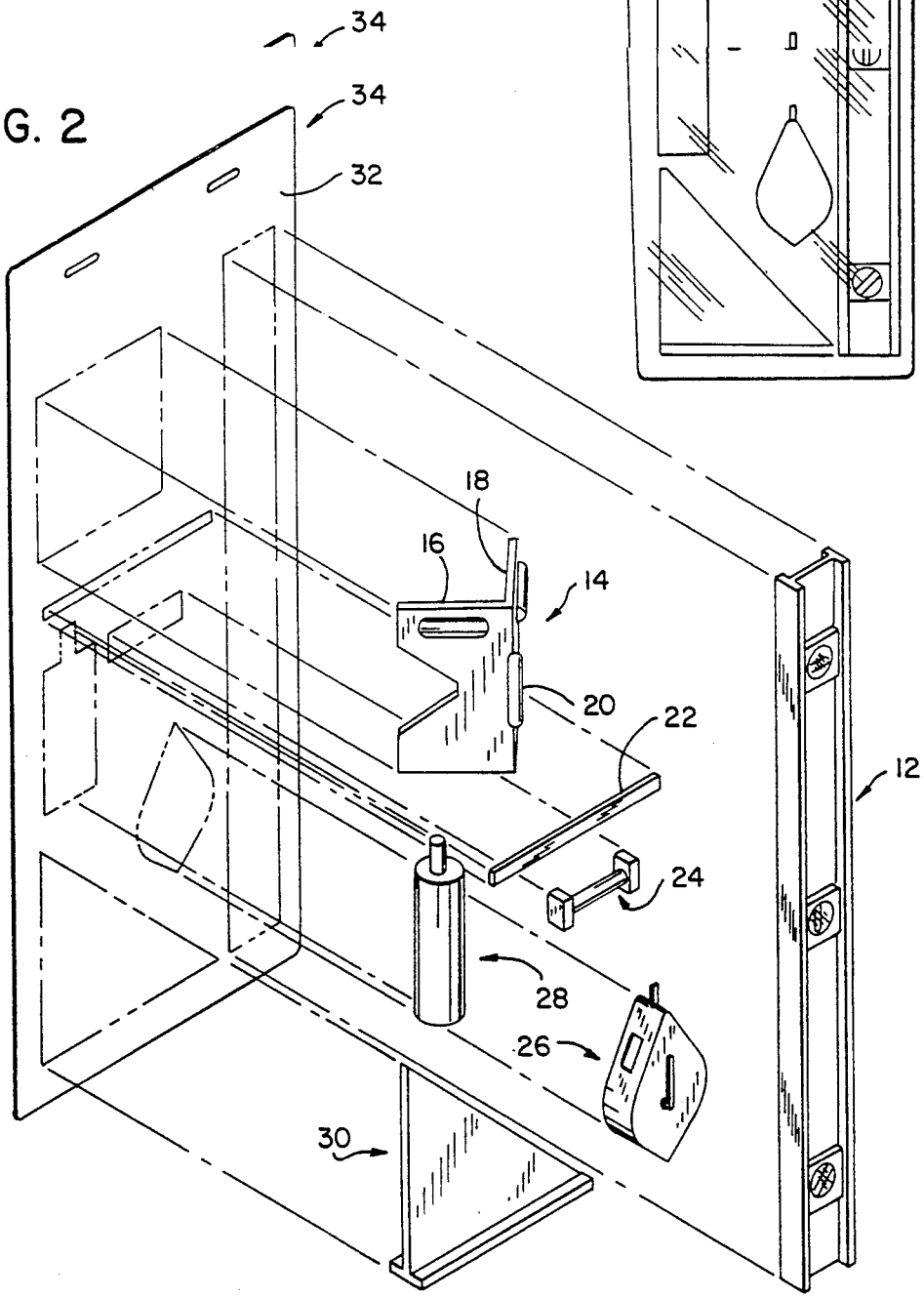
FIG. 2 is an exploded isometric view showing the kit of tools of FIG. 1 and the panel onto which the tools are packaged.

FIG. 2 illustrates the tools included in kit 10. Such tools include an elongated aluminum frame-type level 12, and a post level 14. Frame-type level 12 is preferably a lightweight extruded aluminum level including vials for measuring level, plumb and 45°, and may be that such as is manufactured by Johnson Level & Tool Mfg. Co., Inc. of Mequon, Wis. (Johnson Level) under its Part No. 243. Post level 14 includes a body defining a pair of right angle flanges 16, 18, with a vial mounted to each of flanges 16, 18 so as to be at right angles to each other. Post level 14 further includes a level-indicating vial 20 located at the intersection of flanges 16, 18. A heavy duty rubber band is supplied with post level 14 for securing post level 14 to a post or other member to be leveled or plumbed, for providing hands-free operation. Post level 14 may be that such as is manufactured by Johnson Level under its Part No. 175, and as is disclosed in co-pending patent application Ser. No. 07/794,570 filed Nov. 19, 1991, the disclosure of which is hereby incorporated by reference.

Kit 10 further includes a conventional wood carpenter's pencil 22, and a line level 24. Carpenter's pencil 22 may be that such as is available from Johnson Level under its Part No. CPB. Line level 24 may be that such as is available from Johnson Level under its Part No. 575.

Also included in kit 10 are a chalk line reel 26 and a container 28 containing powdered chalk for use with chalk line reel 26. Chalk line reel 26 is of conventional construction, and may be that such as is available from Johnson Level under its Part No. 3100. Container 28 of powdered chalk may be that such as is available from Johnson Level under its Part No. 3204-B.

Lastly, kit 10 includes an angle square 30. Angle square 30 is typically referred to as a rafter square, and includes graduations along its hypotenuse edge for laying out and determining angles from a pivot point defined at its right angle intersection. Angle square 30 may be that such as is available from Johnson Level under its Part. No. RAS-70.

Kit 10 is a carded assembly, with tools 12, 14, 22, 24, 26, 28 and 30 being placed against the front surface 32 of a panel or card 34. The dashed lines shown in FIG. 2 indicate the positions of the respective tools when they are placed onto panel front surface 32.

Figure 3:
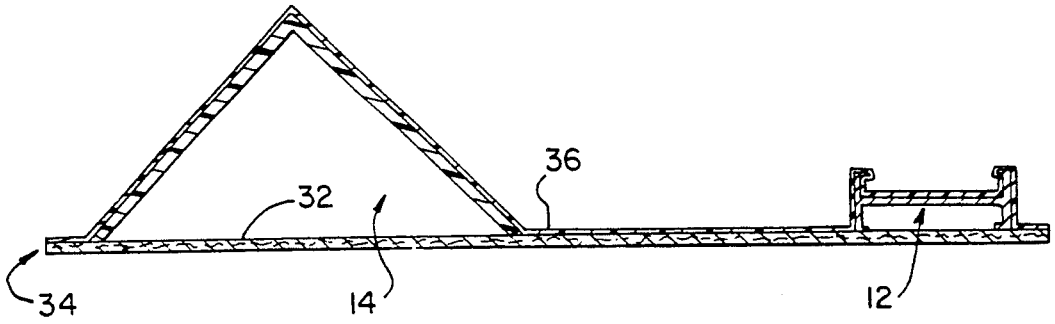
FIG. 3 is a section view taken along line 3—3 of FIG. 1

Once tools 12, 14, 22, 24, 26, 28 and 30 are placed against front surface 32 of panel 34, a conventional transparent shrink wrap material 36 is placed over the tools and shrink wrapped in accordance with known packaging technology to adhere to front surface 32 of panel 44 in the areas of front surface 32 between the tools. This construction is illustrated in FIG. 3 with respect to frame-type level 12 and post level 14. In this matter, tools 12, 14, 22, 24, 26, 28 and 30 are maintained in their positions as shown in FIG. 1 and 2 on front surface 32 of panel 34.

Once the tools are so packaged, kit 10 is adapted to be sold through conventional retail outlets to the homeowner or handyperson for use in building a residential deck or for any other construction project. Level 12 is used in a manner as is known to level or plumb objects. Post level 14 is adapted to be secured to a post and retained thereon while the post is being set, to ensure the post is plumb. Carpenter pencil 22 is used in combination with square 30 or any other satisfactory straight edge to mark lines on boards or the like. Line level 24 is adapted to be hung from a line spanning between two objects, to ensure that the line is level and thereby that certain points on the objects are at the same elevation. Chalk line reel 26 is adapted to be filled with chalk from container 28, and is used in a manner as is known to snap a straight line between two predetermined points. Square 30 is employed as a straight edge, to mark boards for either 90° cuts or for cuts along a certain angle.

Various alternatives and embodiments are contemplated as being within the scope of the following claims particularly pointing out and distinctly claiming the subject matter regarded as the invention.

I claim:

1. A prepackaged kit of tools, comprising:

a post level;

an elongated frame-type level;

one or more marking instruments; and a square;

wherein the post level, the frame-type level, the one or more marking instruments, and the square are contained in a single package, and wherein the one or more marking instruments comprise a chalk line reel.

2. The kit of claim 1, further comprising a container of ground chalk for supplying the chalk line reel, the chalk container being contained in the package.

3. The kit of claim 1 wherein the one or more marking instruments further comprise a pencil.

4. The kit of claim 1, wherein the package is constructed so as to provide visual access to the leveling instruments, the marking instruments and the square, when they are contained within the package.

5. The kit of claim 4, wherein the package includes a panel having a front surface against which the post level, the frame-type level, the one or more marking instruments, and the square are placed, and wherein the package further includes a transparent material bonded to the front surface of the panel and acting to retain the post level, the frame-type, the one or more marking instruments, and the square in predetermined positions on the front surface of the panel.

6. The kit of claim 5, wherein the transparent material comprises a single sheet of shrink wrap material having an adhesive on its rear surface for contacting the front surface of the panel in locations between the post level, the frame-type level, the one or more marking instruments, and the square.

* * * * *